US005996195A

United States Patent [19]

White et al.

[11] Patent Number: 5,996,195

[45] Date of Patent: Dec. 7, 1999

[54] CROSS MACHINE TENSIONING SYSTEM AND METHOD

[75] Inventors: James S. White, Shaftsbury, Vt.; David M. Ascevich, Williamstown; Edward C. Kirchner, Pittsfield, both of Mass.

[73] Assignee: Morrison Berkshire, Inc., North Adams, Mass.

[21] Appl. No.: 09/119,458

[22] Filed: Jul. 20, 1998

[51] Int. Cl.[6] ..... D06C 3/00

[52] U.S. Cl. ..... 26/88; 26/98

[58] Field of Search ..... 26/51, 71, 72, 26/87, 88, 98, DIG. 1

[56] References Cited

U.S. PATENT DOCUMENTS

| | | | |
|---|---|---|---|
| 1,237,607 | 8/1917 | Bolton . | |
| 1,262,740 | 4/1918 | Bolton . | |
| 1,343,385 | 6/1920 | Bolton . | |
| 2,374,980 | 5/1945 | Cook . | |
| 2,481,369 | 9/1949 | Turner | 26/98 |
| 2,581,821 | 1/1952 | Sutton | 26/98 |
| 3,124,834 | 3/1964 | Vandierendonck | 26/88 |
| 3,166,651 | 1/1965 | Leimer et al. | 26/98 |
| 3,166,823 | 1/1965 | Bernard . | |
| 3,216,082 | 11/1965 | Goy . | |
| 3,230,599 | 1/1966 | McKew et al. . | |
| 3,243,978 | 4/1966 | Gowin . | |
| 3,323,703 | 6/1967 | Wibbing et al. | 26/88 |
| 3,414,954 | 12/1968 | Alexeff . | |
| 3,483,601 | 12/1969 | Smith, II . | |
| 3,494,527 | 2/1970 | Bauer et al. | 26/88 |
| 3,540,096 | 11/1970 | Porta . | |
| 3,822,448 | 7/1974 | Cho . | |
| 3,867,744 | 2/1975 | Tsuchida . | |
| 4,053,967 | 10/1977 | Mair . | |
| 4,145,796 | 3/1979 | Mair . | |
| 4,197,621 | 4/1980 | Mair . | |
| 4,295,251 | 10/1981 | Tatham . | |
| 4,329,838 | 5/1982 | Zerle et al. . | |
| 4,330,909 | 5/1982 | Peschke et al. . | |
| 4,447,937 | 5/1984 | Young, Jr. | 26/98 |
| 4,536,927 | 8/1985 | Feyerl et al. . | |
| 4,578,845 | 4/1986 | Young, Jr. | 26/98 |
| 4,760,626 | 8/1988 | Lönner et al. . | |
| 4,760,945 | 8/1988 | Zerle et al. . | |
| 4,777,706 | 10/1988 | Stanislaw . | |
| 4,848,632 | 7/1989 | Mack et al. . | |
| 4,888,234 | 12/1989 | Smith et al. . | |
| 4,891,870 | 1/1990 | Müller et al. . | |
| 4,920,622 | 5/1990 | Mair et al. . | |
| 4,926,530 | 5/1990 | Stanislaw . | |
| 5,031,289 | 7/1991 | LeRoy et al. . | |
| 5,255,419 | 10/1993 | Stanislaw et al. . | |
| 5,355,564 | 10/1994 | Gunter, Jr. et al. | 26/88 |
| 5,421,500 | 6/1995 | Niemann et al. . | |
| 5,460,312 | 10/1995 | Bräu et al. . | |
| 5,575,414 | 11/1996 | Gröninger et al. . | |
| 5,619,779 | 4/1997 | Geyer . | |
| 5,663,510 | 9/1997 | Niemann et al. . | |

OTHER PUBLICATIONS

Erhardt+Leimer GmbH, EL, Spreading Devices, publicly available at least one year prior to Jul. 20, 1998.

*Primary Examiner*—Amy Vanatta

*Attorney, Agent, or Firm*—Lerner, David, Littenberg, Krumholz & Mentlik, LLP

[57] ABSTRACT

An apparatus for tensioning, stretching or pulling a traveling web of material (e.g., single or multiple layers) lateral to the longitudinal or machine direction of the traveling web is disclosed. The apparatus includes at least one but usually a pair of clamping devices to be disposed opposite each other on lateral edges of the traveling web upstream of a processing area where the clamping devices include stationary members, where at least one stationary member includes first and second ends and a material-engagement surface, wherein, when in operational position, the first and second ends define a direction of the material-engagement surface that is transverse to the machine direction of the traveling web. A method of stretching or pulling a single layer or multiple layer web of material laterally to the machine direction of the traveling web to remove wrinkles also is disclosed.

55 Claims, 9 Drawing Sheets

CROSS MACHINE TENSIONING SYSTEM AND METHOD

BACKGROUND OF THE INVENTION

The present invention relates to an apparatus and method for tensioning, stretching, or pulling a sheet-like, or web of, material widthwise and more particularly for tensioning, stretching, or pulling a single layer of sheet-like material, or multiple layers of sheet-like materials, to remove wrinkles, ripples and the like from the material.

Certain types of sheet-like, or webs of, material, such as fabrics, felts, and the like, are processed on needling looms, finishing machines, or other processing equipment to obtain a finished product. At first, the work piece may consist of an unprocessed single layer of material. The work piece also may consist of several layers of material or a laminate. The word "laminate" as used herein should be construed in its broadest sense. That is, the word "laminate" includes a plurality of overlying layers either joined together, or not joined together. The term "web of material" as used herein, in a general sense, refers to either a single layer of material or a laminate.

In a typical setup, a single layer of material, or a laminate, is loaded onto a material-processing machine. The processing of the sheet-like material may include interweaving or needling layers of batt onto it. The processing also may include passing the web of material through a finishing machine.

In certain situations, it may be more desirable to manufacture laminates, instead of a single layer of material. One reason for this is that laminates maintain consistent physical characteristics from product to product. Each layer of a laminate may be constructed differently or may be made of different materials altogether. Often, these multi-layered webs include at least one, and often two or more layers of base material, such as fabric, and layers of batt, which are subsequently interwoven onto the base layers.

As the material is being loaded onto the machine or as the material moves in the machine direction on the machine, one or more of the layers may develop wrinkles, ripples or other non-conformities. One reason for these problems is that the layers are stretched in the machine direction (MD) to pull the circumferences of the layers as close to one another as possible. The machine direction, or MD as used herein, refers to the longitudinal direction that the material travels when moving on a material-processing machine. This pulling in the MD direction causes a change in the material's cross machine direction (CMD) dimension. The cross machine direction or CMD as used herein refers to the lateral direction, which is substantially perpendicular to the machine direction (MD).

This relationship between the pulling in the MD and the shrinkage in the CMD dimension is called the material's contraction ratio. In some instances, the layers are constructed differently. Thus, each layer may have its own contraction ratio. As a result, differential width reductions in neighboring fabrics will result in wrinkles, ripples, and the like, in the layers of material. A single layer may wrinkle, as well, due to the pulling in the MD and the subsequent reduction of the CMD dimension of the single layer.

These non-uniformities typically present significant problems, especially prior to, and/or during, a needling, finishing, or other process. That is, if wrinkles in the layers are processed into the material (e.g., needled in via the needling loom or finished in via the finishing machine), non-uniformities develop in the finished product and the material must be reworked or, worse yet, scrapped altogether. Both of these options prove to be inefficient and costly due to added labor costs, production line shut downs and the need for additional raw materials. On the other hand, if wrinkles, ripples, or other non-uniformities are removed before further processing, they usually do not reappear after the single layer or laminate has been needled, finished or otherwise processed. Thus, there is a need to remove wrinkles from a single layer of material, or from a laminate, prior to further processing on a material-processing machine.

Conventional ways to remove these wrinkles, ripples, and the like, have included manual labor. Typically, at least two, and sometimes as many as six machine operators, are necessary to pull at the lateral sides of a single layer or a laminate to create a sufficient CMD tension. This manual process is extremely costly in terms of the amount of labor hours required to perform a given tensioning session. Also, this manual process is very difficult to repeat with consistent results, due to natural human error. Consistency, however, is important in this type of industry.

Attempts have been made to automate the tensioning or pulling of a web of material in general and specifically in the CMD or widthwise direction. For example, U.S. Pat. No. 3,822,448 to Cho provides an apparatus that includes a pair of rotary discs disposed at opposite side edges of a traveling fabric and a pair of push plates adapted adjacent the rotary discs. The pair of push plates is moved toward or away from the rotary discs in opposing relation thereto for spreading the fabric web widthwise. This apparatus also includes guide rollers positioned ahead of the spreading units to guide the fabric at each edge. These types of spreading apparatus are relatively complicated. They include machine parts, having their own relative motion, that need to interact at precise moments in order to achieve their objective of spreading a web of material. These types of apparatus also require a drive motor to actuate, for instance, the rotary discs. Such drive motors may need to be controlled, maintained, and repaired. In addition, since these types of apparatus are separately driven, and have their own relative motion vis-à-vis the motion of the web, they require extra energy to run. They also may, on occasion, have to be regulated to make sure the relative motions are in synchronization with the traveling web of material. Finally, these types of apparatus appear to only address the spreading of a single layer of material.

SUMMARY OF THE INVENTION

The present invention addresses these and other needs to substantially remove wrinkles, ripples, or other non-uniformities, from a single layer of material or from a laminate.

One advantage of the present invention is that it can pull or stretch a web of material laterally, or in a cross machine direction, to remove a substantial amount of wrinkles prior to, or during, other finishing steps. Another advantage of the present invention is that it can pull or stretch a single layer, or selected layer(s) of a laminate, in order to remove wrinkles from only those selected layer(s). Another advantage of the present invention is that it can remove wrinkles from a single layer of material, or laminate, or selected layers of the laminate, at least until the web has been further processed or until most of the wrinkles have been permanently removed.

In accordance with one aspect of the present invention, there is provided a machine having first and second ends.

The machine is adapted to move a web of material, which has lateral ends, in a machine direction from the first end to the second end of the machine. The processing machine includes at least first and second clamping devices disposed on opposite lateral ends of the web of material. Each of the first and second clamping devices includes a first stationary member having first and second ends and a material-engagement surface extending therebetween. The first and second ends define a direction of the material-engagement surface which is transverse to the machine direction. The clamping devices also include a second stationary member arranged in an opposing relationship to the first stationary member. One of the first and second stationary members is movable between an open position, in which the web can freely pass through the first and second stationary members, and a closed position, in which the second stationary member urges a respective lateral end of the web into engagement with the material-engagement surface, whereby when the web moves in the machine direction across the transversely arranged material-engagement surface, the respective lateral end of the web is moved laterally of the machine direction. Preferably, each material-engagement surface includes a plate having substantially parallel ridges and valleys. Each of the plates is arranged with respect to the web of material such that the ridges and the valleys extend along the direction of the material-engagement surfaces of the first stationary member transverse to the machine direction. That is, when the web of material travels in the machine direction relative to the ridges and valleys of each of the plates, the lateral ends of the web are urged laterally outward.

Preferably, each of the second stationary members includes a plate having substantially parallel ridges and valleys. The plates of each of the first and second stationary members are opposed from each other and adapted to contact respective opposing surfaces of the web of material when the stationary members are in the closed position. More preferably, the ridges and valleys of each of the plates are alternately and oppositely arranged with respect to each other. Most preferably, the ridges of one of the plates substantially mesh with the valleys of the other of the plates when the respective stationary members are in the closed position.

Preferably, each of the first and second clamping devices includes a top spar and a bottom spar. Each spar has a free end and a second end. Each free end supports one of the stationary members. Preferably, each stationary member is attached to a spars by a flexible joint to permit the stationary member to float with the web of material as the web of material travels in the machine direction. The flexible joint may include an elastomeric member disposed between the respective spar and the stationary member. Alternately, the flexible joint may be a ball joint disposed between the respective spar and the stationary member.

Preferably, the first and second stationary members are rotatably attached to the free ends of the respective spars such that the ridges and valleys are rotatable from an aligned position to the machine direction to a transverse position, i.e., at a predetermined angle to the machine direction. Most preferably, the predetermined angle is about 45°.

In accordance with another aspect of the present invention, each of the stationary members includes a roller. The roller may be opposed to the plate. Alternatively, each of the stationary members includes a pair of rollers. Here, as well, the rollers may be opposed to the plate as well.

Preferably, the ridges on the plates may be raised portions having relatively smooth surfaces such that the web of material is permitted to travel over the ridges in the machine direction while migrating outwardly toward the lateral ends in the cross machine direction. More preferably, the plate includes a material having a relatively low coefficient of friction. Most preferably, the material comprises nylon.

In accordance with another aspect of the present invention, there is provided a system for tensioning or pulling a traveling web of material, which has lateral ends. The web of material moves in a machine direction. The system includes at least first and second clamping devices disposed or opposite lateral ends of the web of material. Each of the clamping devices has first and second stationary members arranged in opposite relationship to one another. Preferably, each of the first stationary members includes a plate with substantially parallel ridges and valleys. Each of the plates is arranged with respect to the machine direction of the web of material such that the ridges and the valleys extend transversely to the machine direction i.e., outwardly toward the respective lateral end in the machine direction. Each of the first stationary members is movable with respect to the respective second stationary members between an open position, in which the web of material can freely pass through the system, and a closed position, in which the stationary members clamp the web of material therebetween, such that when the web of material travels in the machine direction, the web of material is pulled outwardly, thereby tensioning the web of material in a cross-machine direction.

Preferably, each clamping device further comprises a top spar and a bottom spar for supporting the stationary members. More preferably, the bottom spar is connected to a mounting apparatus for mounting the system to a processing machine. The bottom spar may also be directly connected to the processing machine itself.

The mounting apparatus preferably includes a mounting carriage and a rail having a top portion and a bottom portion. The top portion of the rail is attached to the mounting carriage and the bottom portion of the rail is attached to a portion of a material processing machine. The bottom portion of the rail may include an adjustment member for adjusting the system with respect to the material-processing machine to allow for proper alignment of the clamping devices with respect to the material-processing machine.

Still further, in accordance with yet another aspect of the present invention, there is provided a method for tensioning a traveling web of material having lateral ends. The method includes providing at least one clamping device having first and second opposed stationary members moveable between an open position, in which the stationary members are separated from one another, and a closed position in which the stationary members are adapted to grip onto the end of the web therebetween, for tensioning the traveling web of material. Preferably, the at least first stationary member includes a plate with substantially parallel ridges and valleys. The method further includes: adjusting the position of the stationary members such that the ridges and the valleys of the plate extend transverse to the machine direction; moving the web of material in a machine direction past the at least one clamping device; and closing the stationary members such that the web travels relative to the ridges and valleys of the plate to thereby urge the lateral end of the web laterally to the machine direction.

Preferably, the method includes the step of opening the stationary members after the step of closing the stationary members. More preferably, the method includes the step of laterally adjusting the stationary members widthwise along the lateral ends of the web of material prior to the step of closing the stationary members.

Preferably, this method includes the step of allowing the web of material to make several passes through the at least one clamping device in the closed position and then moving the stationary members to the open position.

In accordance with yet another aspect of the present invention, there is provided a clamping device for tensioning a web of material. The clamping device includes a first stationary member having first and second ends and a material-engagement surface extending therebetween. The first and second ends define a direction of the material-engagement surface, that is transverse to the machine direction. The clamping devices also include a second stationary member arranged in an opposing relationship to the first stationary member. One of the first and second stationary members is moveable between an open position, in which the web can freely pass through the first and second stationary members, and a closed position, in which the second stationary member urges a respective lateral end of the web into engagement with the material-engagement surfaces, whereby when the web moves in the machine direction across the transversely arranged material-engagement surface, the respective lateral end of the web is moved laterally of the machine direction. Each of the first stationary members preferably includes a plate having substantially parallel ridges and valleys. The plate is arranged with respect to the web such that the ridges and valleys extend transversely, i.e., at an angle, to the machine direction. In addition, the first and second stationary members are movable with respect to each other between an open position, in which the web can freely pass through the first and second stationary members, and a closed position, in which the first and second stationary members clamped the web therebetween, such that when the web travels in the machine direction relative to the ridges and valleys of the plate, the web of material is stretched or pulled outwardly, thereby urging the web of material in a cross-machined direction. Preferably, this clamping device further includes third and fourth stationary members disposed on the web adjacent the first and second stationary members, respectively.

BRIEF DESCRIPTION OF THE DRAWINGS

The foregoing and other objects, advantages, characteristics and features of the present invention will become apparent, as will a better understanding of the concepts underlying the present invention, with reference to the description, which follows and refers to the accompanying drawings in which.

DETAILED DESCRIPTION OF THE INVENTION

Figure 1:
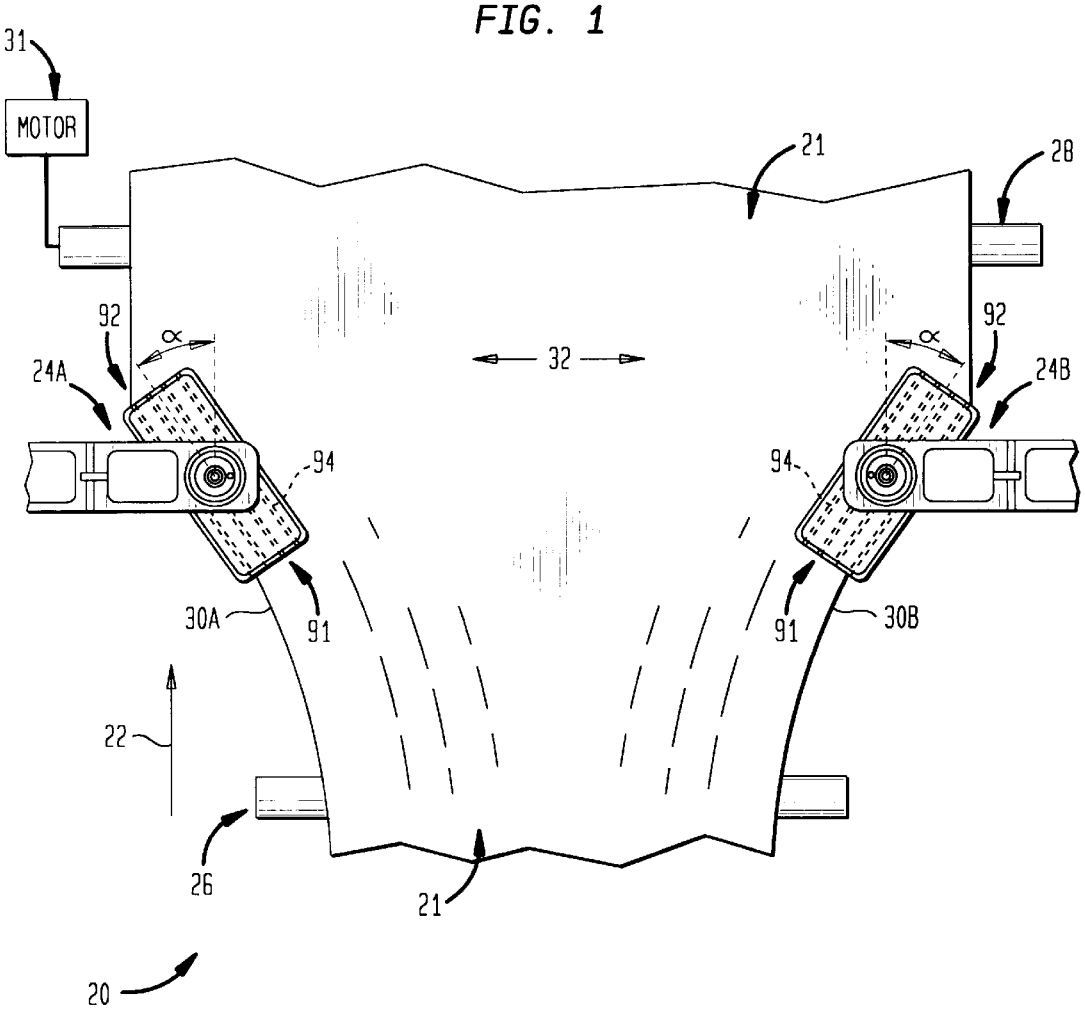
FIG. 1 is a top plan schematic representation of a portion of a material-processing machine that includes a pair of clamping devices in accordance with one embodiment of the present invention.

Referring now to the figures, FIG. 1 illustrates the primary elements of a material-processing machine in accordance with the present invention. This type of machine may be used to treat a single layer of material, or equally, to treat multiple layers of material, (referred to herein as a laminate), such material-processing machine being generally designated as 20. The processing machine 20 typically includes a drive system for moving the material in a longitudinal or machine direction (MD) designated by arrow 22, and a cross machine tensioning system comprising a pair of clamping devices generally designated as 24A and 24B. The processing machine 20 is particularly adapted for use with a processing machine that may comprise a single layer of material, or a laminate, 21 and a needling process (not shown) or finishing process (not shown) downstream of the clamping devices 24A and 24B. However, it is to be understood that the clamping devices 24A and 24B may be used, either singularly or as a pair, in connection with material processing machines of any type. That is, the type of downstream processing step is not critical to the present invention. Rather, the present invention may be used with any machine that includes a traveling single layer of material or a laminate, where wrinkles, ripples or other non-uniformities occur and must be removed prior to manufacturing the finished product.

The means for moving the material 21 typically may include a tension roll 26 and a pull-through roll 28. These rolls are arranged substantially perpendicular to the machine direction (MD) 22 of the web of material 21. The web of material has lateral sides or ends 30A and 30B. The pull-through roll 28 is rotated by a motor 31, shown as a black box in FIG. 1. The pull-through roll 28 thus pulls the web of material in the machine direction 22 past the clamping devices 24A and 24B. Just downstream of the clamping devices, 24A and 24B, is a processing zone 32, which performs, for example, a needling process on the material 21. The details of the processing zone 32 are not shown. In general, however, it is desirable to position or arrange the clamping devices 24A and 24B close to the downstream processing area, such as the processing zone 32. This ensures that the material 21 is pulled, tensioned, or stretched to make it virtually wrinkle-free just prior to entering such processing stage. It is contemplated that the clamping devices, 24A and 24B, may be located anywhere on the web of material, as required for a given process. FIG. 1 illustrates the clamping devices, 24A and 24B, adjacent the processing zone 32 prior to the pull-through roll 28, in accordance with the configuration of this particular embodiment.

Figure 2A:
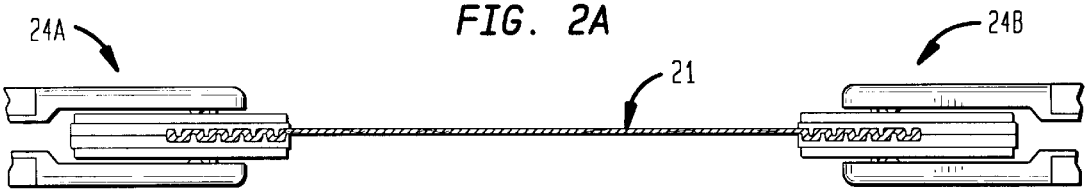
FIG. 2A is an elevational view of a portion of the machine of FIG. 1, showing a side view of the clamping devices.

The clamping devices 24A and 24B, shown in more detail in FIG. 2A, are virtually the same apparatus. They may be orientated in a left-handed or right-handed manner, but otherwise, they are the same device. Thus, for purposes of clarity in describing the present invention, clamping device 24B will be described in detail. It is to be understood, though, that this description applies to clamping device 24A as well. In FIG. 2A, the clamping devices 24A and 24B are in the closed position, and therefore are shown in operation mode i.e., pulling, stretching, tensioning and/or smoothing the web of material 21. As noted before, the web of material can be either a single layer of material or a laminate. Thus, FIG. 2A equally applies to both scenarios. It should be noted, as will be described in detail herein, that the web of material 21 travels past the clamping devices 24A and 24B even as the clamping devices are in their closed position.

Figure 2B:
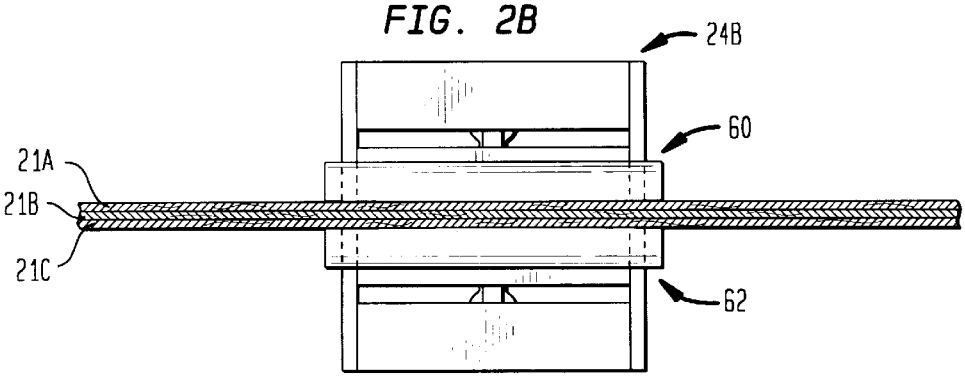
FIG. 2B is an end elevational view of one of the clamping devices of FIG. 2A, showing the stationary members in a closed position, gripping several layers of material of a laminate.
Figure 2C:
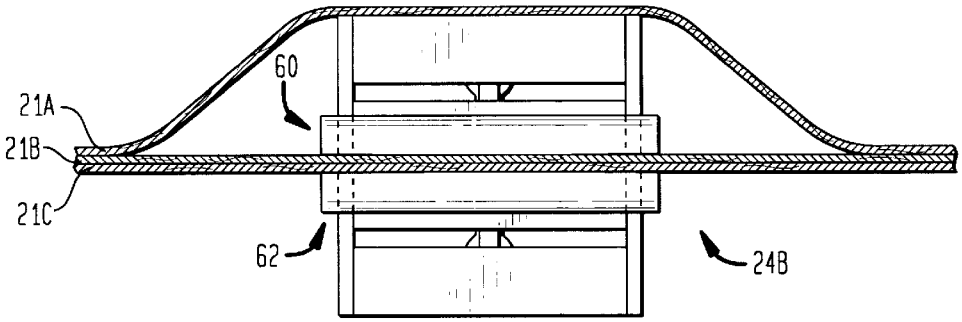
FIG. 2C is an end elevational view of the clamping device of FIG. 2B, showing the stationary members gripping the bottom two layers of the laminate.
Figure 2D:
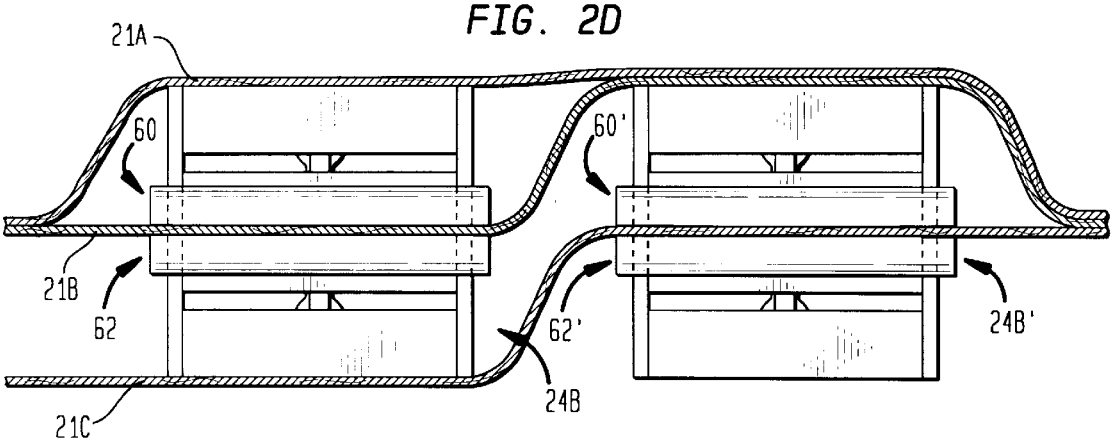
FIG. 2D is an end elevational view of two clamping devices, showing corresponding pairs of stationary members gripping the second layer and the third layer of the laminate.

FIGS. 2B, 2C and 2D depict three of many possible modes of operation for pulling, tensioning, stretching and/or smoothing a laminate comprising at least two layers. These three modes are not exhaustive, but are rather mere examples of the variations of uses for the clamping devices contemplated by the present invention. Referring now to FIG. 2B, the clamping device 24B is depicted in a side elevation view. Also, the clamping device 24B is in a closed, operational position. Layers 21A, 21B and 21C also are shown from a side elevation view as they travel through the clamping device 24B. In FIG. 2B, all three layers are clamped by the clamping device and are being pulled in the respective cross-machine or lateral direction in order to remove a substantial amount of wrinkles that may have occurred due to their multiple layer arrangement or different contraction ratios.

In FIG. 2C, the clamping device 24B is shown to be stretching or pulling at least the bottom two layers of the laminate, namely, 21B and 21C. Top layer 21A is being guided over the top portion of the clamping device. In this mode, the bottom two layers are being pulled, tensioned, stretched and/or smoothed and the top layer is in a free-flowing mode. This configuration is best used when the bottom two layers have developed wrinkles due to the stretching in the machine direction (MD) and subsequent contraction in the cross-machine direction (CMD) dimension, and where the top layer is mostly devoid of such problems. This configuration also may be implemented where the top layer is being processed in such a way where it cannot have a clamping member clamping it, but rather must be free-flowing.

FIG. 2D depicts yet another mode of operation or configuration in accordance with the present invention. In this mode, there are two clamping devices per lateral end of material. In FIG. 2D, clamping device 24B is acting upon at least the middle layer 21B and a second clamping device 24B' is acting upon at least the bottom layer 21C. Again, in this particular mode of operation, the top layer 21A is free-flowing and not affected by either of the clamping devices 24B or 24B'.

Figure 3:
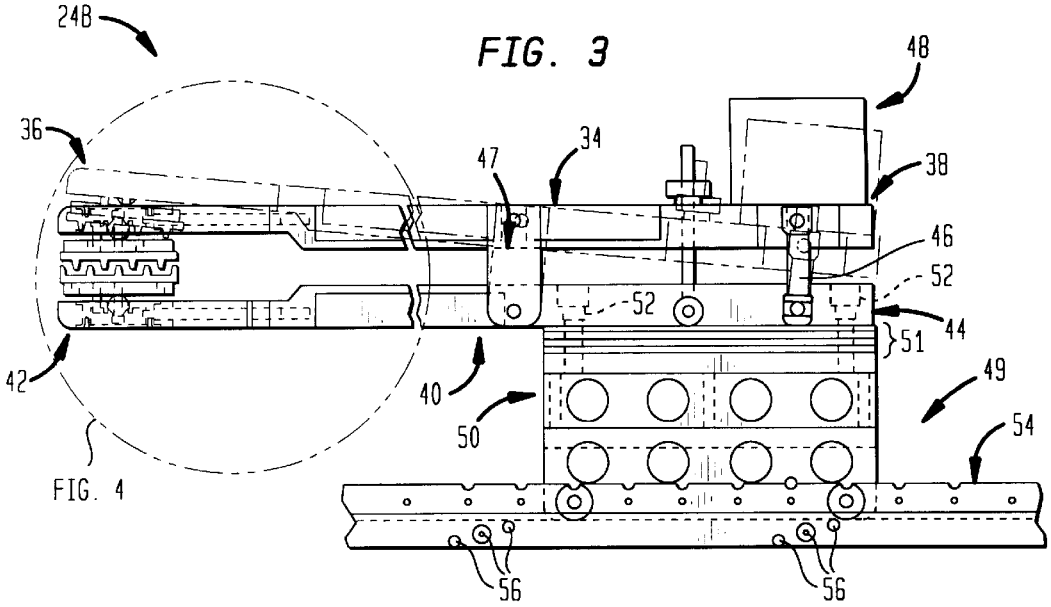
FIG. 3 is a side elevational view of one of the clamping devices shown in FIG. 1, illustrating the mounting apparatus in accordance with one embodiment of the present invention.

Referring now to FIG. 3, the clamping device 24B in accordance with a preferred embodiment includes a top spar 34. The top spar has a free end 36 and a second end 38. The clamping device 24B further includes a bottom spar 40 having a free end 42 and a second end 44. The top spar 34 and bottom spar 40 are pivotally connected at their respective second ends, 38 and 44, via piston 46. The top spar 34 and bottom spar 40 also are connected at roughly their center by a rocker plate 47. These connection points allow the top spar 34 to pivot from an open position (shown in phantom in FIG. 3) to a closed position (shown in solid outline). When in the closed position, the top spar 34 is substantially parallel to the bottom spar 40 and the respective free ends, 36 and 42, are moved closer to each other.

The pivoting action from an open to a closed position to an open position again is actuated by an actuator 48. This actuator 48 appears on top in the figures, but it is to be understood that the actuator 48 may be attached below the bottom spar 40. This actuator 48 may comprise either a pneumatic device including an air cylinder system, or a hydraulic system, or an electromechanical system, or other suitable actuating mechanism for pivoting the spars about plate 47.

In this embodiment, the bottom spar 40 is secured to a mounting apparatus 49 with securement elements 52. Preferably, securement elements 52 are threaded bolts but can be any type of securement element such as screws, clamps, braces, quick-release devices, and the like. The mounting apparatus 49 includes a mounting member 50, preferably mounted such that the clamping devices are cantilevered. Mounting member 50 is mounted to a rail 54. The rail is typically integral with the processing machine 20 (not shown in FIG. 3). the clamping device 24B can be moved laterally, toward and away from the lateral end 30B of the web of material by moving it along the rail 54. The lateral movement toward and away from the web of material is determined, in part, by the need for more or less engagement of the fabric by the clamping devices, 24A and 24B, and/or the particular type of process being performed. In addition, being arranged to be removably secured allows for the clamping devices to be moved away from the material-processing machine 20 when they are no longer in use. This allows the clamping devices to be used at another material processing machine, perhaps within the same facility, increasing the overall yield of that factory. The movability or removability of the clamping devices is also advantageous to allow them to be moved out of place when a web of material needs to be mounted or unmounted from the processing machine 20.

In an alternate embodiment, the clamping devices may be mounted on the floor of the facility housing the processing machine. In yet another alternate embodiment, there may be a movable carriage for mounting the clamping devices directly to the processing machine. Thus, the clamping devices may be attached directly to the processing machine and either be movable, non-movable and/or removable or non-removable from the machine 20.

As best shown in FIG. 3, the mounting apparatus 49 includes shims 51 which are disposed between the bottom spar 40 and the mounting carriage 50. These shims 51 are used to adjust the height of the clamping device 24B so that it is in alignment with the web of material 21 with respect to the pitch and yaw.

In addition, as best shown in FIG. 3, the rail 54 also includes adjustment holes 56 for adjusting the pitch, yaw, and height of the clamping devices. By attaching the rail to the remaining portion of the processing machine (not shown) and selecting the appropriate set of adjustment holes 56 to mount the bottom portion of the rail 54, the clamping device 24B can be ultimately aligned with, or be at the same pitch and yaw as, the web of material 21 as it travels past the clamping device 24B. Thus, the rail 54, and therefore the entire clamping device 24B, including the mounting carriage 50, may be adjusted for pitch and yaw to achieve the above purpose of aligning the system with the web of material 21.

Figure 4A:
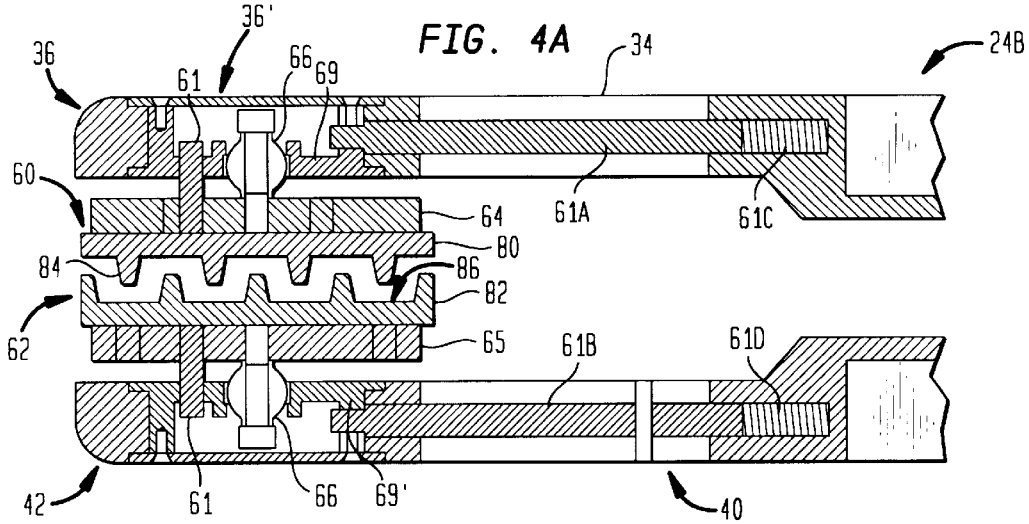
FIG. 4A is an enlarged view of the free end of the clamping device as shown in FIG. 3.
Figure 4B:
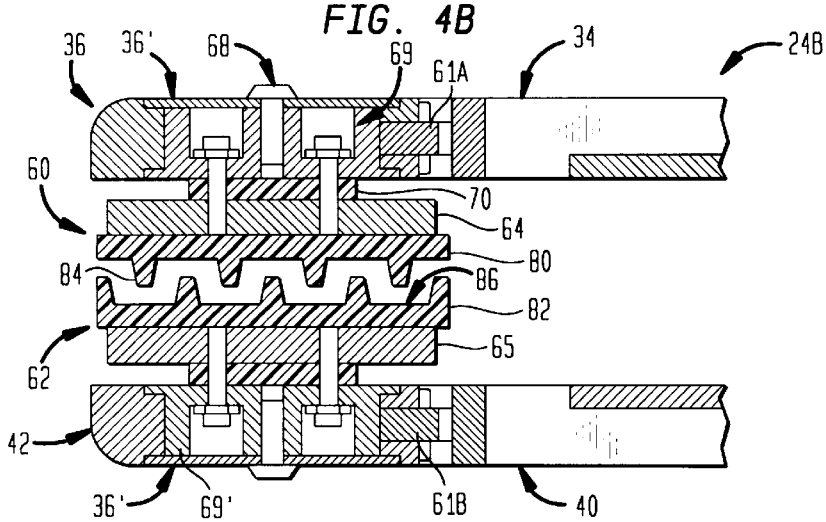
FIG. 4B is an enlarged view of the free end of another embodiment of a clamping device showing an alternate flexible joint disposed between the top and bottom spars and their respective stationary members.
Figure 5A:
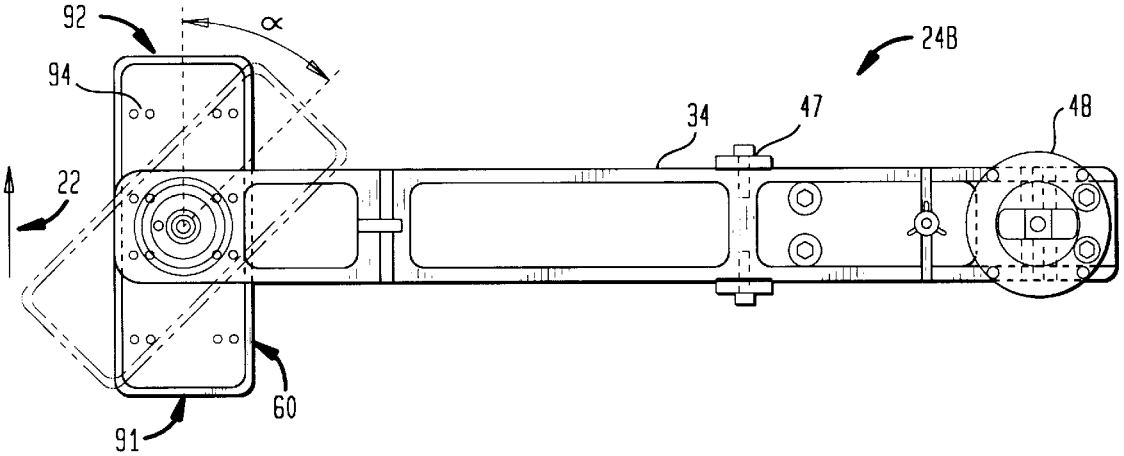
FIG. 5A is a top plan view of one of the clamping devices shown in FIGS. 1, 3 and 4A–4C.

As best shown in FIGS. 4A and 4B, a stationary member 60 is connected to the free end 36 of the top spar 34 and a second stationary member 62 is connected to the free end 42 of the bottom spar 40. As shown in FIG. 5A, both stationary members 60 and 62 are preferably rotatably connected to their respective spars 34 and 40. This rotation is preferably between about a 0° angle and about a 60° angle transverse to the machine direction 22. A predetermined transverse angle in this range, represented by the symbol α, is preferably set by an operator prior to closing the stationary members 60, 62 and pulling or stretching the web of material 21. Most preferably, a( is set to about a 45° transverse angle to the machine direction.

Stationary member 60 in this embodiment preferably includes a base member 64, which is the portion of the stationary member 60 that is rotatably connected to the top spar 34 with a securement member 66. Preferably, the securement member 66 is a flexible securement member, which allows the stationary member 60 to be rotated to a particular transverse angle to the MD and then preferably locked-in via a locking pin 61 prior to the use of the clamping device 24B. However, any type of securement member which is capable of rotatably securing the base member 64 to the top spar 34 is contemplated. For instance, the flexible joint may be a ball joint arrangement as shown in FIG. 4A. It also may be a shoulder bolt 68 and a piece of elastomeric material 70 arrangement as shown in FIG. 4B. Locking pin 61 holds the stationary members 60 and 62 in position, but allows slight movement with respect to the web. Locking pin 61 also preferably holds the position of the stationary members in holding positions of between about 0° to 60° in about 15° increments. Spring loaded pins 61A and 61B, which are biased by springs 61C and 61D, respectively, are used to interface with rotating members 69 and 69'. Thus, the stationary members can be rotated at increments of about 15° each from the MD. This is best shown in FIGS. 5C and 5D. Slots 63 are arranged around disk 69 such that each slot movement rotates the disk 69 and thus the stationary members at about 15° transverse increments to the MD.

The stationary members 60 and 62 are flexibly joined to the top and bottom spars respectively such that there is some relative movement with respect to the clamping devices. This movement allows the stationary members to float with the web of material 21 as the web travels in the machine direction and to track the movement of the web so that the stationary members are capable of gripping the web as it passes through in a consistent manner, even when the web varies in its position.

In a similar, but opposing, configuration to the top stationary member 60, stationary member 62 preferably includes a base member 65, which is rotatably connected to the bottom spar 40. Base member 65 also is constructed and arranged to rotate similarly to base member 64.

As best shown in FIG. 5A, the stationary members 60 and 62 are rotatable to an angle of about 45° transverse to the machine direction for operational purposes. This transverse angle is represented by α. The rotation is made in increments of about 15° due to the structure of the disk 69 and the slots 63 as shown in FIGS. 5C and 5D. In this regard, spring-loaded pins 61A and 61B are retracted so that the stationary members can be rotated freely. When the desired angle α is determined, the spring-loaded pins 61A and 61B are allowed to expand into the appropriate slot 63 to lock the angular rotation of the stationary members in place.

Figure 5B:
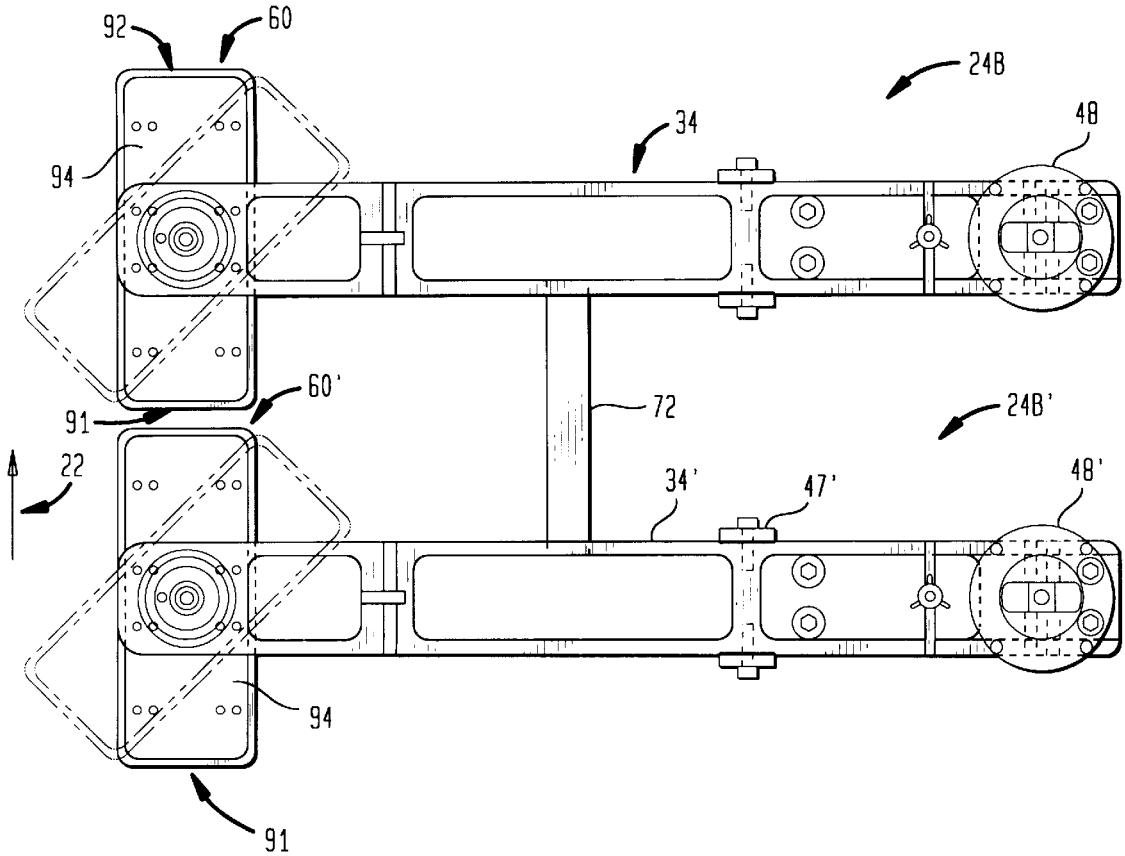
FIG. 5B is a top plan view of an alternate, dual clamping device such as that shown in FIG. 2D.
Figure 5C:
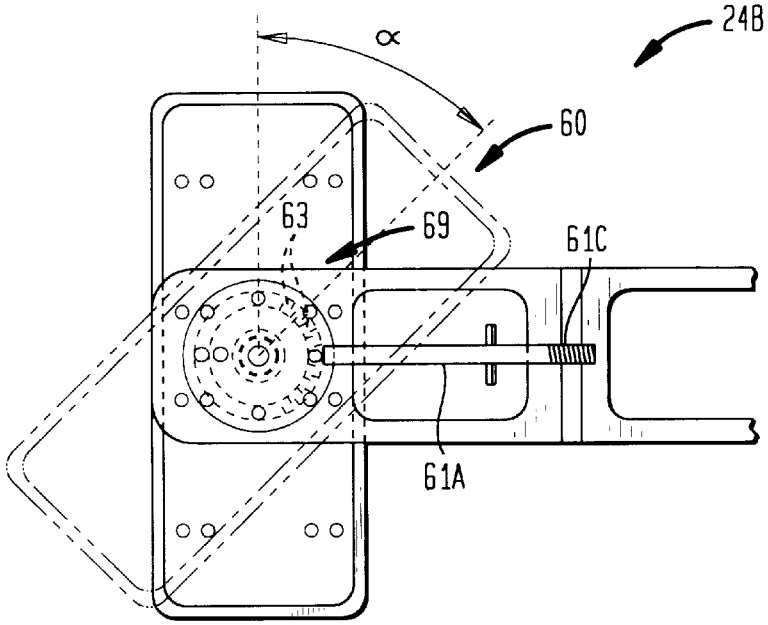
FIG. 5C is an enlarged top plan view of FIG. 5A, showing the locking mechanism of the rotating stationary members.
Figure 5D:
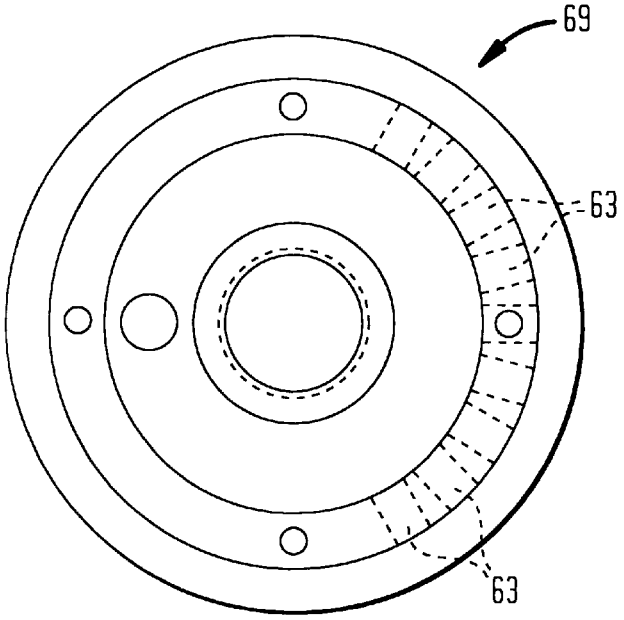
FIG. 5D is an enlarged view of the locking mechanism of FIG. 5C, showing further detail of the locking disk.

FIG. 5B is an alternative embodiment of the clamping device 24B in that instead of having one clamping device 24B, there is provided a second clamping device 24B'. Both are on the same side of the web in this configuration. The configuration in FIG. 5B corresponds to that depicted in FIG. 2D. Each clamping device is virtually identical to the other and all descriptions of 24B equally apply to the second clamping device 24B'. The two clamping devices may be attached by a bar 72. This bar 72 is included to allow the clamping devices to work together. Alternately, this bar may be attached on the bottom spars 40 and 40' to provide stability for the clamping devices and to allow the top spars 34 and 34' to work independently of each other. As mentioned before, in this mode, each individual clamping device 24B and 24B' is capable of acting upon different layers of a laminate. They may also act upon all of the layers as one. In an alternate embodiment, there may be more than one set of clamping devices, 24B and 24B'. That is, there may be two or more sets of clamping devices 24B and 24B' on each lateral side of the web 21.

Figure 6A:
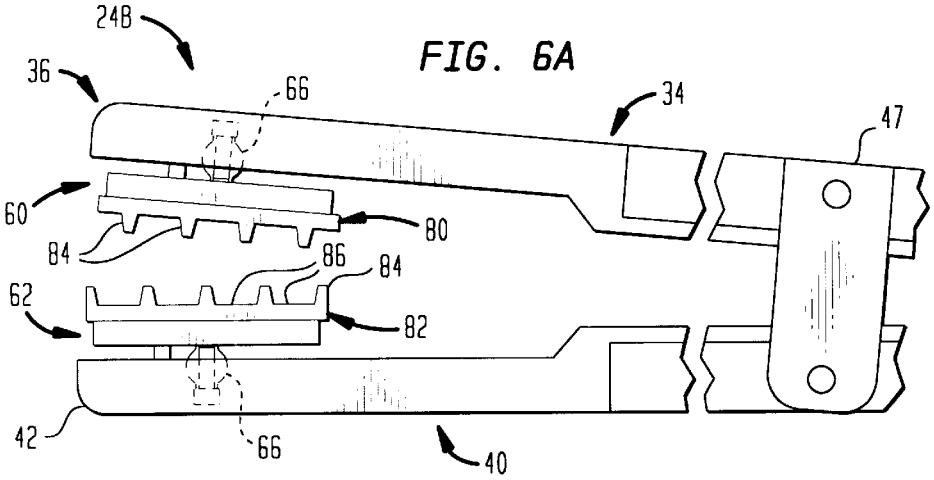
FIG. 6A is an enlarged side elevational view of the free end of one of the clamping devices in accordance with the embodiment of FIG. 2A, showing the clamping device in an open position.
Figure 7A:
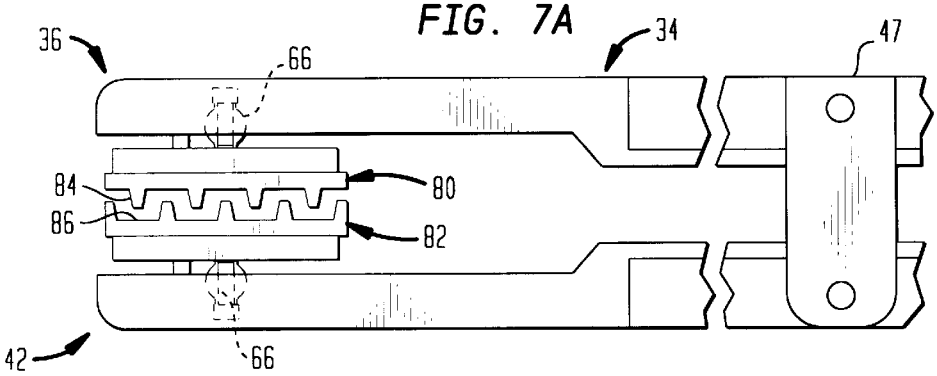
FIG. 7A is the clamping device of FIG. 6A in a closed position.

In this preferred embodiment, each of the stationary members 60 and 62 include plates 80 and 82, respectively. As best shown in FIGS. 6A and 7A, plates 80 and 82 include several rows of substantially parallel ridges 84 and valleys 86, as arranged in such a way that when in position for pulling or tensioning the web of material, extend at an angle transverse the web of material 21 toward the respective lateral end 30B respectively, of the web 21. Specifically, when the clamping devices are in a closed position (FIG. 7A), the ridges 84 of the plate 80 mesh with the valleys 86 of the other plate 82 and vice versa. When the top spar 34 and the bottom spar 40 are in a closed position, plates 80 and 82 are opposed and communicate in a meshing fashion to create a clamping force therebetween. This clamping force, however, is at a level whereby it permits the traveling web to pass through. For example, the actuation pressure typically is between about 40 psi and 70 psi, although other pressures may be used such as between about 1 psi and 100 psi. When clamping a single layer, the pressure is about 40 psi and when clamping multiple layers, the pressure is about 60 psi. When in the open position (FIG. 6A), the web of material 21 may freely travel between the clamping devices 24A and 24B without being influenced by the ridges 84 and valleys 86. The web is urged outwardly by the movement of the lateral ends of the web over the ridges and into the valleys. Since the ridges and valleys are at an angle to the movement of the web, when the web travels over them, it is channeled or forced to migrate outwardly. In its most simplest form, (see FIGS. 5A and 5B) the bottom 62 stationary member includes a first end 91, a second end 92, and a material engagement surface, which extends between the first end 91 and second end 92. The first end 91 and second end 92 define a direction of the material-engagement surface that is transverse to the MD. When the top stationary member 60 closes down on the bottom stationary member 62, the respective lateral end of the web is urged laterally of the MD. It is believed that this is due to the torturous path that the lateral end of the web experiences as it has to changed its course from a longitudinal or machine direction to a transverse or lateral direction.

Figure 6B:
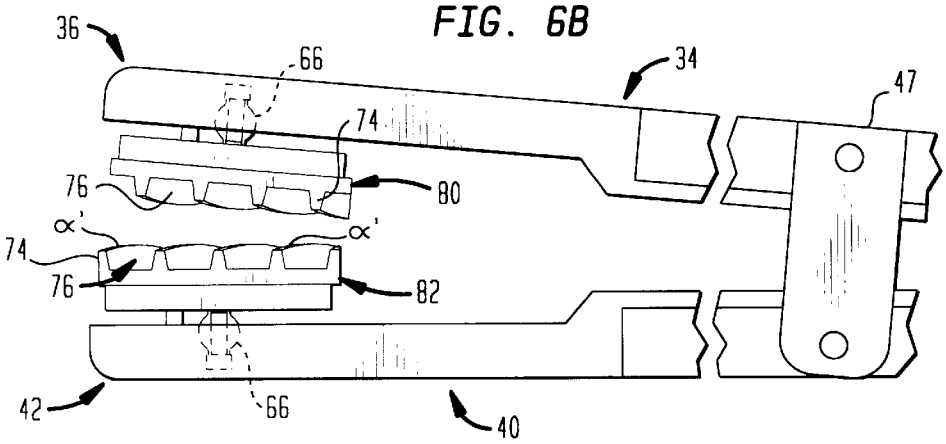
FIG. 6B is an enlarged side elevational view of the clamping device of FIG. 6A showing an alternate plate having different arrangements of ridges and valleys.
Figure 7B:
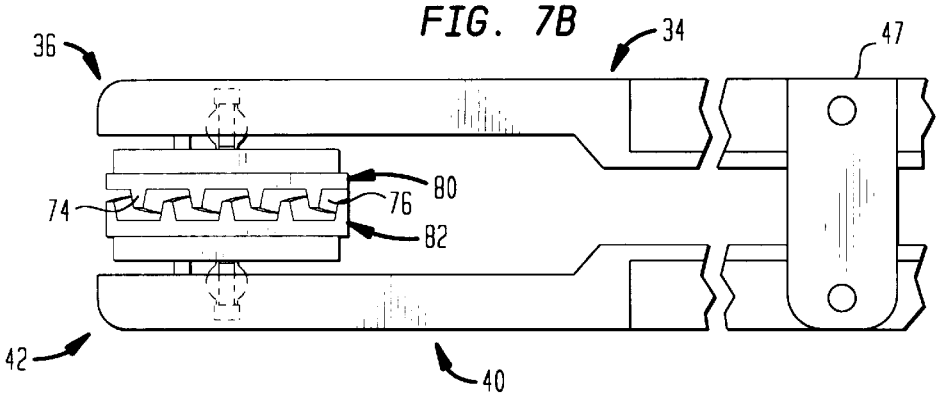
FIG. 7B is the clamping device of FIG. 6B showing the clamping device in a closed position.

As an alternative to the ridges 84 and valleys 86 of plates 80 and 82, FIGS. 6B and 7B show ridges 74 and valleys 76, which have different shapes and orientation with respect to the plates 80 and 82. In this particular embodiment, the ridges 74 and valleys 76 are still substantially parallel to each other, but here they are now also askewed on the plates such that they include their own transverse angle to the machine direction when in operational position. This transverse angle is represented by $\alpha'$. In addition, the ridges 74 have a slightly convexed shape such that the overall contour of the ridges 74 are crown-like. That is, the ridges 74 taper on opposing ends of the plates 80 and 82. The ridges may be shaped in various other ways and geometrical shapes provided they operate to urge the material laterally.

The plates 80 and 82 in the preferred embodiments are integral with the ridges 84 and valleys 86. This is true as well for the alternate embodiment of ridges 74 and valleys 76. The material used for the plates and/or ridges and valleys is any type of material which is capable of allowing a web of material to pass through it when it is gripping the material while still being strong enough to withstand the pressures asserted upon it during an operation. In a preferred embodiment, this material is nylon. However, it can be any material which has a low enough coefficient of friction to allow the web to travel even when the clamping devices are in a closed position, but high enough to engage the web of material.

The elastomeric material 70 can be made of any type of flexible material which acts as a bushing or cushioning between the spars and the base plates. As depicted in the figures, the plates are rectangular in shape. However, any shape that is capable of tensioning the web of material is contemplated by the present invention. In the preferred embodiments, the rectangular plates are about 12" inches long and about 5" inches wide. The height of the ridges of the preferred embodiment shown in FIGS. 6A and 7A extend from the plate about ⅜". However, it is to be noted that the height of the ridges can be any size provided that they perform the function of causing the web to migrate or pull out to the lateral sides when in the closed position.

In the alternate embodiment of FIGS. 6B and 7B, the ridges may be 0.38" high, 0.4" wide, and, as described previously, the free end of the ridges are convex in a crown-like manner. The other of the pair of stationary members is attached to the free end of a corresponding bottom spar.

Figure 4C:
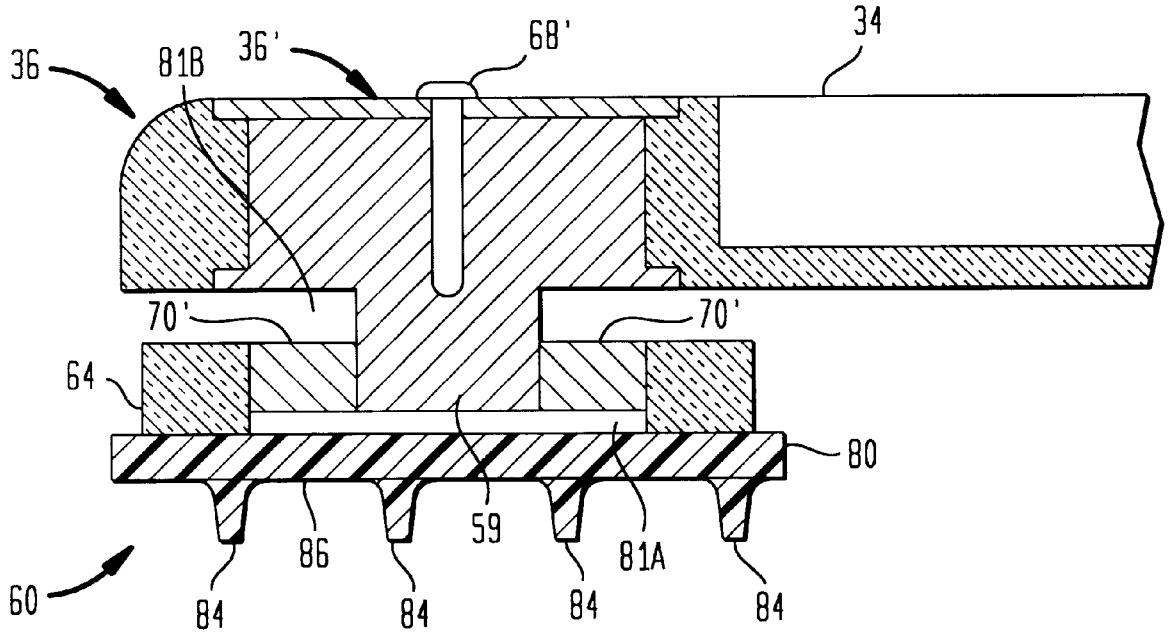
FIG. 4C is an enlarged partial view of the free end of yet another embodiment of the flexible joint disposed between the top and bottom spar(s) and the respective stationary member(s), showing only the top spar and stationary members.

FIG. 4C shows yet another embodiment of the flexible joint arrangement. Similar to the embodiment shown in FIG. 4B, the embodiment of FIG. 4C shows an elastomeric material 70' disposed between the base member 64 and a center pivot 59. Gaps 81A and 81B allow for relative movement of the stationary member 60 so that it is capable of floating with the web of material as the web of material changes in position. Thus, elastomeric member 70' acts as a flexible joint between the base plate 64 and the center pivot 59 such that the plate 80 which is attached to the base 64 is somewhat flexible. Similar to the embodiment of FIG. 4B, this particular embodiment includes a button head screw 68' which secures the center pivot 59 to the free end 36 of the top spar 34 via hold down plate 36'.

Although not shown, it should be understood that there is an equal and opposite bottom spar including the flexible joint set-up as described above for the top spar portion. Thus, the bottom portion in this particular embodiment as shown in FIG. 4C would include all those elements described above and be constructed and arranged similar to the bottom portion shown in FIGS. 4A and 4B.

Thus, the method in accordance with this aspect of the present invention contemplates the provisions of a material processing machine 20 (FIG. 1) having a tensioning device including clamping devices 24A and 24B as shown in the figures. As noted earlier, material moving means other than the material moving system described and illustrated herein may be used in accordance with the present invention. The web of material 21, at a minimum, must travel from an initial upstream point to a downstream point and pass through the clamping devices. The web may be a single layer or may be a laminate, consisting of at least two layers.

In the illustrated embodiment, the web of material 21 is loaded onto the material processing machine 20 and at least between the tension roll 26 and the pull-through roll 28 so that the web of material is arranged to travel through the clamping devices 24A and 24B. In a needling loom set up, for example, the clamping devices are set up adjacent the first processing zone 32. However, the same set of clamping devices may be set up just prior to second or third processing zones (not shown). Alternatively, two sets of pairs of clamping devices may be set up just upstream of each needling zone.

Referring to FIG. 1, the pull-through roll 28 is rotated by means of the motor 31 in the machine direction (MD) as denoted by arrow 22. This causes the web of material 21 to eventually begin traveling in the MD from the tension roll 26 to the pull-through roll 28. At this initial start-up phase, the clamping devices 24A and 24B may be in an open position as described herein. The web of material 21 is, therefore, able to travel freely past the clamping devices 24A and 24B. The stationary members 60 and 62 are set to a preferable $\alpha$ angle based on the amount of pulling, tensioning, or stretching that is needed for a given web of material or laminate of layers. This is normally set, in a preferred embodiment, to about 45° angle transverse the MD.

As the web of material 21 continues to turn through the material-processing machine 20, it is tensioned in the MD. This is especially necessary when there are several layers of material that are being laminated together. In such situations, the laminated layers are tensioned in the MD to pull the circumferences of the layers as close to one another as possible. This MD tension causes a reduction in the CMD dimension. Since the several layers of web may be differently constructed, certain wrinkles will appear on certain layers at different locations and at different times. This is true because the different layers may have different contraction ratios.

Thus, the wrinkles, ripples, and the like, must be removed before the web of material, and in this case, the laminated layers of material, are needled, finished or subjected to some other process. This tensioning is preferably performed just prior to the downstream processing stage. It also can be performed during the downstream processing.

For instance, in a needling loom set up, the traveling web of material 21 may make several revolutions in order to tighten the multiple layers in the MD. Just prior to the further processing step occurs, the actuator 48 is activated and the top spar 34 of each clamping device 24A, 24B moves downward toward the respective bottom spar 40 until the ridges 84 of the first plate 80 mesh with the valleys 86 of the second plate 82, and vice versa. The traveling web 21 continues to travel downstream while the stationary members are in a closed position. In this particular embodiment, the meshing of the ridges 84 and valleys 86 causes the lateral ends 30A and 30B of the web 21 to follow a torturous path and be pulled over the ridges and into the valleys and thus, stretch outwardly from the center portion of the web 21. This is believed to be due to the force or gripping effect of the stationary members 60 and 62 and the substantially parallel ridges 84 and valleys 86, which channel the web over the ridges and into the valleys in opposing widthwise directions as the web 21 travels downstream past the clamping devices 24A and 24B. It also is believed to be true with any stationary member having a material-engagement surface, with or without ridges, when the surface is transverse to the MD. The amount of pulling, stretching, or tensioning is a function of the pressure, ridge geometry, plate material, fabric or web material, CMD tension, MD tension and other machine and fabric variables. It is also a function of the transverse angle of the stationary members to the web. However, any particular configuration is contemplated that provides for tensioning and stretching of the web at its lateral ends 30A and 30B or adjacent its lateral ends, whereby a substantial amount, if not all, of the wrinkles, ripples, or other non-uniformities are removed from the web prior to a needling, finishing or other setting process.

A suitable mechanism (not shown) may be provided for controlling the tension, pressure, actual amount of stretch or other parameters. This mechanism also may monitor these parameters as well as the load machine parameter. For example, load cells may be provided that would monitor the tension or load of the web. Also, there may be a displacement measuring device for monitoring the actual migration or stretching of the web of material. As another example, there may be provided a displacement drive unit which automatically sets the amount of stretch, monitors the movement and provides a feedback loop for sending information back to a control system. The control system would then make the necessary adjustments accordingly. The control system may be either manual, automatic or a combination of both.

While the clamping devices 24A and 24B are in their closed position and, as such, the wrinkles are being removed from the web or laminated layers, the downstream needling or other process is activated. As the web or laminate passes the processing zone 32 or other processing area, the web or laminate is set into a finished product. At that point in certain processes, the wrinkles are permanently removed and there is typically no more need to tension or stretch the material. Thus, after the traveling web of material 21 has made at least one full revolution of the material processing machine 20 and has been processed by the needling loom, finishing machine or other processing machine, the clamping devices 24A and 24B are activated, via actuator 48, to their open position. The web of material 21 is again free to travel past the clamping devices for further processing if needed.

As an alternative method, after the clamping devices 24A and 24B have been placed in the closed position, and the downstream process has occurred, the clamping devices are kept in the closed position for several more revolutions to ensure that the wrinkles are substantially removed from the web of material 21. That is, in certain processes, and where certain types of fabrics are used, after the first pass-through, the wrinkles still appear on the finished product. Therefore, the clamping devices may remain in the closed position for several more revolutions in order to completely or substantially remove the non-uniformities in the single layer or laminate.

In another alternative method, the clamping devices may be placed in the closed position before the web of material begins to travel, or is made to travel, through the clamping devices. Thus, in this particular mode of operation, the top spars 34 of the clamping devices 24A, 24B are actuated by the actuator 48 down onto the bottom spars 40 into a closed position as the material remains stationary. Next, the material is caused to start moving and accordingly begins to be pulled, tensioned, or spread by the clamping devices outwardly from the center of the web transverse to the MD. This motion as described above causes the wrinkles to be removed from the single web of material or from the laminate.

One advantage of this particular process is that the clamping devices may be removed from the material processing machine 21 to be used on another machine or merely to not interfere with the removal of the final manufactured web of material. The clamping devices are moved along the rail 54 away from the lateral ends 30A and 30B of the web.

Figure 8:
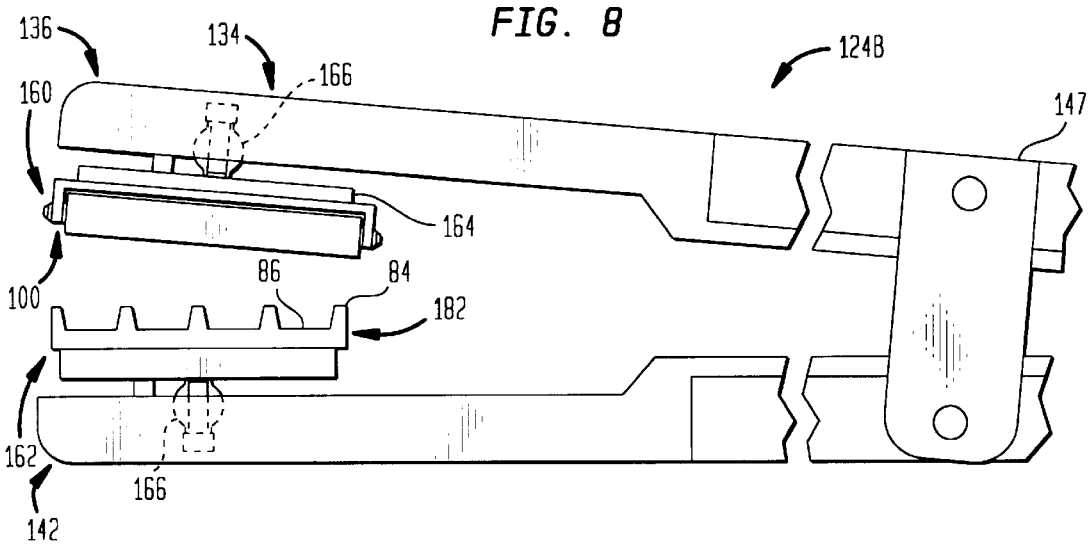
FIG. 8 is an enlarged side elevational view of the free end of a clamping device in an open position, including stationary members in accordance with another embodiment of the present invention.
Figure 9:
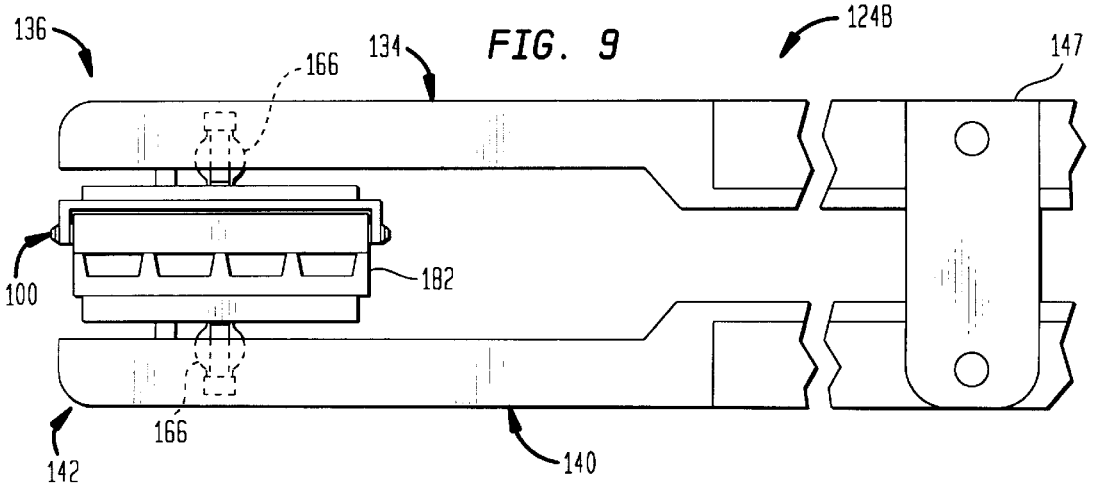
FIG. 9 is the clamping device of FIG. 8 in a closed position.
Figure 10:
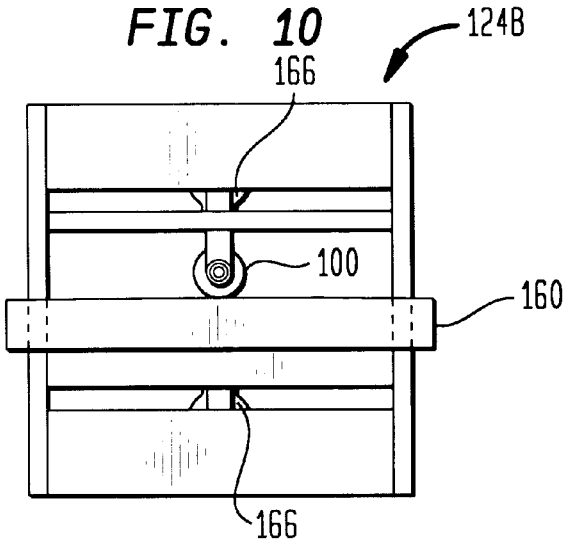
FIG. 10 is a front elevational view of the stationary members of FIG. 9.
Figure 11:
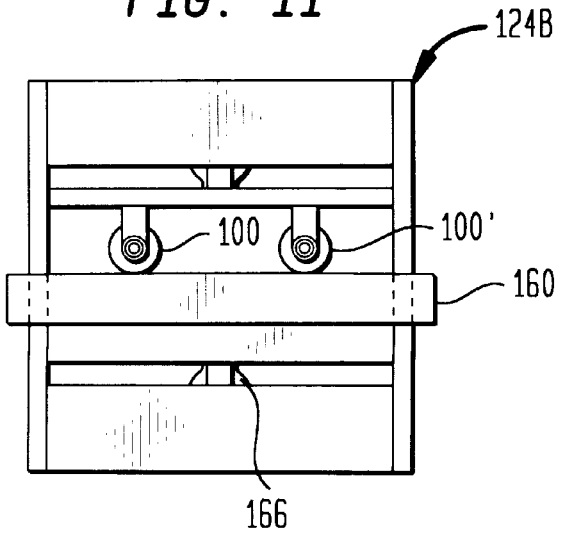
FIG. 11 is a front elevational view of the stationary members of FIG. 9, showing an alternate two roller embodiment.

In an alternate embodiment, the upper plate 80 with ridges 84 is replaced by a roller 100, or a pair of rollers, as best shown in FIGS. 8, 9, 10 and 11. Referring now to FIG. 8, clamping device 124B includes roller 100, which is rotatably secured to the top spar 134 by way of the base member 164, using securement elements 166. The operation of this embodiment is similar to that described above, except that the stationary members 160 and 162 do not mesh. Rather, the roller 100 is brought in contact with the bottom plate 182. A predetermined amount of pressure is applied by the actuator 48 (not shown in FIG. 8) such that the same or similar pulling or spreading effect is realized with respect to the web of material 21. That is, when the clamping device 124B in this embodiment is in its closed position, the traveling web of material 21 is pulled at its lateral ends 30A and 30B and thus removes the wrinkles that may be present. FIG. 10 shows this embodiment with one roller 100. FIG. 11 shows the same embodiment having two rollers 100 and 100'. These particular embodiments are also capable of being rotated such that the stationary members are at a transverse angle $\alpha$. to the machine direction (not shown).

While the foregoing description and figures illustrate preferred embodiments of the system and method in accordance with the present invention, it should be appreciated that certain modifications can be made, and are indeed encouraged to be made, in the structure, arrangement and use of the disclosed embodiments without departing from the spirit and scope of the present invention, which is intended to be captured by the claims set forth below.

What is claimed is:

1. A machine having first and second ends, and being adapted to move a web of material, which has lateral ends, in a machine direction from said first end to said second end of said machine, said machine further comprising:

a. at least first and second clamping devices disposed on opposite lateral ends of the web of material, each of said at least first and second clamping devices comprising:

1) a first stationary member having first and second ends and a material-engagement surface extending therebetween, said first and second ends defining a direction of said material-engagement surface that is transverse to said machine direction; and 2) a second stationary member arranged in an opposing relationship to said first stationary member, at least one of said first and second stationary members being movable with respect to the other of said first and second stationary members between an open position, in which the web of material can freely pass through said first and second stationary members, and a closed position, in which said second stationary member urges a respective lateral end of the web into engagement with said material-engagement surface, whereby when the web of material moves in said machine direction across said transversely arranged material-engagement surface, the respective lateral end of the web is moved laterally of said machine direction.

2. The machine of claim 1, wherein said material-engagement surface of each of said first stationary members comprises a plate having substantially parallel ridges and valleys; each of said plates being arranged with respect to the web such that said ridges and said valleys extend from said first end to said second end of said first stationary member transverse to said machine direction.

3. The machine of claim 2, wherein each of said second stationary members comprises a plate having substantially parallel ridges and valleys, said plates of said first and second stationary members being opposed from each other and adapted to contact opposing surfaces of the web when said first and second stationary members are in said closed position.

4. The machine of claim 3, wherein said ridges and said valleys of said plates of said first and second stationary members are alternately and oppositely arranged with respect to each other.

5. The machine of claim 4, wherein said ridges of each of said plates of said first stationary members substantially mesh with said valleys of each of said plates of said second stationary members when each of said first and second stationary members are in said closed position.

6. The machine of claim 3, each of said first and second clamping devices further comprising a top spar and a bottom spar, each of said top spars and said bottom spars having a free end and a second end, each said free end of said top and bottom spars supporting one of said first and second stationary members.

7. The machine of claim 6, wherein said first and second clamping devices include a flexible securement member for flexibly securing said first and second stationary members to said top and bottom spars respectively, each of said flexible securement members permitting said first and second stationary members, respectively, to float with the web as the web travels in said machine direction.

8. The machine of claim 7, wherein said flexible securement member is an elastomeric member.

9. The machine of claim 7, wherein said flexible securement member is a ball joint.

10. The machine of claim 6, wherein each pair of said top spar and said bottom spar are pivotally mounted to each other at said second end.

11. The machine of claim 10, further comprising an actuator for actuating said top and bottom spars to thereby move each of said first and second stationary members from said open position to said closed position.

12. The machine of claim 11, wherein said actuator is selected from a group comprising a pneumatic device, a hydraulic device, or an electromechanical device.

13. The machine of claim 12, wherein said actuator exerts a predetermined force on the web of material.

14. The machine of claim 13, wherein said predetermined actuator pressure ranges from about 1 psi to about 100 psi.

15. The machine of claim 6, wherein each of said first and second stationary members are rotatably attached to said free ends of said top spar and said bottom spar, respectively, such that said plates having ridges and valleys are rotatable from an aligned position with said machine direction to a position transverse to said machine direction.

16. The machine of claim 15, wherein each of said first and second stationary members extend in a predetermined transverse direction.

17. The machine of claim 16, wherein said predetermined transverse direction is adjustable.

18. The machine of claim 17, wherein said predetermined transverse direction is about a 45° angle transverse to said machine direction.

19. The machine of claim 1, in combination with a web of material comprising a plurality of layers of material.

20. The machine of claim 19, wherein said clamping devices grip at least one of said plurality of layers.

21. The machine of claim 19, wherein said clamping devices grip at least two of said plurality of layers.

22. The machine of claim 19, wherein said clamping devices grip at least three of said plurality of layers.

23. The machine of claim 2, wherein each of said second stationary members includes at least one roller, each of said rollers being opposed to each of said plates of each of said first stationary members.

24. The machine of claim 23, wherein each of said second stationary members includes a pair of rollers, said rollers being opposed to each of said plates.

25. The machine of claim 23, wherein each of said first and second clamping devices further comprising a top spar and a bottom spar, each of said top spars and said bottom spars having a free end and a second end, each said free end of said top and bottom spars supporting one of said first and second stationary members.

26. The machine of claim 25, wherein said first and second clamping devices include a flexible securement member for flexibly securing each of said first and second stationary members to each of said top and bottom spars, respectively, each of said flexible securement members permitting said first and second stationary members, respectively, to float with the web as the web travels in said machine direction.

27. The machine of claim 26, wherein said flexible securement member is an elastomeric member.

28. The machine of claim 26, wherein said flexible securement member is a ball joint.

29. The machine of claim 25, wherein each pair of said top spar and said bottom spar are pivotally mounted to each other at said second end, and each of said clamping devices further comprises an actuator for actuating said top and bottom spars to thereby move each of said first and second stationary members from said open position to said closed position.

30. The machine of claim 25, wherein each of said first and second stationary members are rotatably attached to said free ends of said top spar and said bottom spar, respectively, such that said stationary members are rotatable from an aligned position with said machine direction to a transverse position to said machine direction.

31. The machine of claim 1, wherein said clamping devices are removably arranged on opposite lateral ends of the web.

32. The machine of claim 2, wherein said plate comprises a base on which said ridges and said valleys are integrally disposed.

33. The machine of claim 2, wherein said ridges comprise raised portions having relatively smooth surfaces.

34. The machine of claim 1, wherein said clamping devices are adjustable in the cross machine direction for accommodating varying widths of the web of material.

35. The machine of claim 1, wherein each of said material-engagement surfaces comprises a material having a relatively low coefficient of friction.

36. The machine of claim 35, wherein said material comprises nylon.

37. A system for tensioning a traveling web of material, which has lateral ends, the web having a relative movement in a machine direction, said system comprising:

a. at least first and second clamping devices disposed on opposite lateral ends of the web of material, each of said clamping devices comprising first and second stationary members arranged in an opposing relationship to one another;

b. each of said first stationary members comprising first and second ends and a material-engagement surface extending therebetween, said first and second ends defining a direction of said material-engagement surface that is transverse to said machine direction; and c. each of said second stationary members being arranged in an opposing relationship to each of said first stationary members, at least one of said first and second stationary members being movable with respect to the other of said first and second stationary members between an open position, in which the web of material can freely pass through each of said first and second stationary members, and a closed position, in which each of said second stationary member urges a respective lateral end of the web into engagement with said material-engagement surface of each of said first stationary member, whereby when the web of material moves in said machine direction across said transversely arranged material-engagement surface, the respective lateral end of the web is moved laterally of said machine direction.

38. The system of claim 37, wherein each of said second stationary members comprises a plate having substantially parallel ridges and valleys, each of said first and second stationary members being opposed from each other and adapted to contact opposing surfaces of the web when said stationary members are in said closed position.

39. The system of claim 38, wherein each of said clamping devices further comprises a top spar and a bottom spar for supporting each of said first and second stationary members, respectively, each of said bottom spars being connected to a mounting apparatus for mounting said system to a material-processing machine.

40. The system of claim 39, wherein said mounting apparatus comprises:

a. a mounting carriage; and b. a rail comprising a top portion and a bottom portion, said top portion of said rail being attached to said mounting carriage and said bottom portion of said rail being attached to the material-processing machine, and said bottom portion including adjustment holes for adjusting said clamping device with respect to the material-processing machine to allow for alignment of said clamping device on the material-processing machine with respect to the web.

41. A method for tensioning a traveling web of material, which has lateral ends, comprising the steps of:

a. providing at least one clamping device having first and second opposed stationary members movable between an open position, in which the stationary members are separated from one another and a closed position, in which said stationary members are adapted to grip onto a lateral end of the web therebetween, for stretching the web of material, at least said first stationary member comprising first and second ends and a material-engagement surface;

b. adjusting the position of said first stationary member such that said first and second ends define a direction where said material-engagement surface is transverse to said machine direction;

c. moving the web of material in a machine direction past said at least one clamping device; and d. closing said first and second stationary members such that the second stationary member urges the lateral end of the web of material into engagement with said material-engagement surface of said first stationary member, whereby when the web of material moves in said machine direction across said transversely arranged material-engagement surface, the lateral end of the web is moved laterally of said machine direction.

42. The method of claim 41, further comprising the step of opening stationary members after said step of closing said stationary members.

43. The method of claim 41, further comprising the step of laterally adjusting said at least one clamping device along the lateral end of the web prior to said step of closing said stationary members.

44. The method claimed in claim 41, wherein each of said first and second stationary members comprise first and second plates, each of said plates having substantially parallel ridges and valleys and wherein said step of closing said stationary members further comprises the step of meshing each of said ridges of each of said first plates with said valleys of each of said second plates.

45. The method of claim 41, wherein the web of material comprises a plurality of layers.

46. The method of claim 45, wherein said step of closing said stationary members comprises stationary opposing surfaces of a selected one of said layers.

47. The method of claim 45, wherein said step of closing said stationary members comprises stationary opposing surfaces of at least two of said layers.

48. The method of claim 45, wherein said step of closing said stationary members comprises stationary opposing surfaces of at least three of said layers.

49. The method of claim 41, further comprising the steps of arranging the web of material to make several passes through said stationary members in said closed position and then moving said stationary members to said open position.

50. A clamping device for pulling a web of material comprising:

a. a first stationary member having first and second ends and a material-engagement surface extending therebetween, said first and second ends defining a direction of said material-engagement surface that is transverse to said machine direction; and b. a second stationary member arranged in an opposing relationship to said first stationary member, at least one of said first and second stationary members being movable with respect to the other member between an open position, in which the web of material can freely pass through said first and second stationary members, and a closed position, in which said stationary members urge a respective lateral end of the web into engagement with said material-engagement surface, whereby when the web of material moves in said machine direction across said transversely arranged material-engagement surface, the respective lateral end of the web is moved laterally of said machine direction.

51. The clamping device of claim 50, wherein said material-engagement surface of said first stationary member comprises a plate having substantially parallel ridges and valleys, said ridges and said valleys being transverse to said machine direction.

52. The clamping device of claim 50, further comprising third and fourth stationary members disposed on the web adjacent said first and second stationary members.

53. The clamping device of claim 51, wherein each of said second stationary members comprises a plate having substantially parallel ridges and valleys, said plates of said first and second stationary members being opposed from each other and adapted to contact opposing surfaces of the web when said first and second stationary members are in said closed position.

54. The clamping device of claim 53, wherein said ridges and said valleys of said plates of said first and second stationary members are alternately and oppositely arranged with respect to each other.

55. The clamping device of claim 54, wherein said ridges of each of said plates of said first stationary members substantially mesh with said valleys of each of said plates of said second stationary members when each of said first and second stationary members are in said closed position.

* * * * *